US007666125B2

(12) United States Patent
Martin et al.

(10) Patent No.: US 7,666,125 B2
(45) Date of Patent: Feb. 23, 2010

(54) PORTABLE LEG EXERCISE DEVICE, AND RELATED METHODS

(75) Inventors: J. True Martin, Tallahassee, FL (US); Wallace Kent Martin, Tallahassee, FL (US)

(73) Assignee: J. True Martin Irrevocable Trust, Tallahassee, FL (US)

( * ) Notice: Subject to any disclaimer, the term of this patent is extended or adjusted under 35 U.S.C. 154(b) by 834 days.

(21) Appl. No.: 11/142,368

(22) Filed: Jun. 2, 2005

(65) Prior Publication Data

US 2006/0276316 A1 Dec. 7, 2006

(51) Int. Cl.
*A63B 21/00* (2006.01)

(52) U.S. Cl. ..... 482/142; 482/907; 5/630; 297/423.1

(58) Field of Classification Search ..... 482/142, 482/130, 907; 5/613, 620, 622, 630, 632, 5/636, 652

See application file for complete search history.

(56) References Cited

U.S. PATENT DOCUMENTS

| | | | | |
|---|---|---|---|---|
| 2,132,862 | A | 10/1938 | Pilates | |
| 3,641,601 | A | 2/1972 | Sieg | |
| 3,890,004 | A * | 6/1975 | Rail | 297/423.1 |
| 4,483,533 | A | 11/1984 | Mangiapane | |
| 4,830,366 | A | 5/1989 | Ruden | |
| 5,026,050 | A | 6/1991 | Leung et al. | |
| 5,630,777 | A | 5/1997 | Garren et al. | |
| 5,697,873 | A | 12/1997 | Van Straaten et al. | |
| 6,292,964 | B1 * | 9/2001 | Rose et al. | 5/630 |
| 6,371,894 | B1 | 4/2002 | Hill | |
| 2004/0198570 | A1 | 10/2004 | Tanglos | |
| 2005/0138733 | A1 * | 6/2005 | Riesberg et al. | 5/640 |
| 2005/0261114 | A1 * | 11/2005 | Heitzman et al. | 482/142 |

OTHER PUBLICATIONS

"Hydraulic Circuit—Hip Adductor/Abductor", http://www.multistationgym.com/curvemaster-hip-adductor-abductor.html.
"Hydraulic Circuit—Hip Adductor/Abductor", http://www.multistationgym.com/curvemaster-hip-adductor-abductor.html, Apr. 22, 2004.

* cited by examiner

*Primary Examiner*—Jerome Donnelly
(74) *Attorney, Agent, or Firm*—Berenato & White, LLC

(57) ABSTRACT

A portable leg exercise device is provided for permitting a user to perform both adductor thigh muscle movements and abductor thigh muscle movements.

23 Claims, 4 Drawing Sheets

PORTABLE LEG EXERCISE DEVICE, AND RELATED METHODS

FIELD OF THE INVENTION

The present invention relates to an exercise device and methods. More particularly, the present invention relates to exercise devices and methods that permit both ambulatory and non-ambulatory individuals to perform a variety of lower extremity exercises.

BACKGROUND OF THE INVENTION

Participation in muscle conditioning and exercise routines produces various health benefits. By sustaining a routine regularly for a prolonged period, the exerciser can increase overall strength and fitness levels and develop a toned body and sculpt muscles. Such exercise routines can also be used to rehabilitate injuries or lessen the effects of temporary or permanent physical limitations or disabilities. Many people choose to perform their exercise regimens in public gyms, which offer a wide array of workout equipment and classes for exercising all major and most secondary muscle groups in the human body and acquiring cardiovascular workouts. For many other people, however, work and domestic demands, or other burdens or encumbrances such as temporary or permanent physical limitations or disabilities make it impossible to visit the gym on a consistent basis.

As an alternative to exercising at public gyms, other individuals choose to exercise at home. However, home exercise is not without its problems. For one, most homes lack sufficient space to accommodate exercise equipment. Additionally, exercise equipment tends to be relatively heavy and cumbersome, making its transport and storage within the home difficult.

The vast majority of exercise equipment directed to lower body exercises provides a dedicated bench or seat that the user must first move themselves into in order to accomplish the exercise. Such devices can either be of limited or no use to individuals who have physical limitations or disabilities such as those temporarily or permanently confined to a wheelchair. For many such individuals, it is either not possible or not safe to attempt to move themselves from the wheelchair to the exercise device and back even when assisted. Other devices that can be used by a person while remaining in a wheelchair or the like, frequently fail to possess adequate safety features or fail-safe mechanisms so that user is not forced into a potentially dangerous position when they are too tired to continue to do the exercise.

Still another problem is that many home exercise devices isolate on a particular muscle group without also training the opposing muscle group equally, leading to disparities in opposing muscle group strength and flexibility. Imbalances between opposing muscle groups can render the exerciser prone to injury, especially muscle pulls and tears.

SUMMARY OF THE INVENTION

It is therefore an object of the invention to provide a portable exercise device that may be used at home as part of a consistent exercise routine and requires small storage space.

Another object of the invention is to provide an exercise device that trains opposing muscle groups.

To achieve one or more of the foregoing objects, and in accordance with the purposes of the invention as embodied and broadly described herein, according to a first aspect of this invention there is provided a portable leg exercise device comprising a support, a resiliently compressible central resistance element connected to the support, and resiliently compressible first and second outer resistance elements connected to the support. The central resistance element is sized to fit between opposite thighs of an individual in a sitting position, and has sufficient compressibility to permit the individual to perform adductor thigh muscle movements to resiliently deform the central resistance element between the opposite thighs. The outer resistance elements are situated on and spaced apart from opposite sides of the central resistance element by sufficient spacing to receive a first of the thighs between the central and first outer resistance elements and to receive a second of the thighs between the central and the second outer resistance elements. The outer resistance elements have sufficient compressibility to permit the individual to perform abductor thigh muscle movements to resiliently deform the outer resistance elements outwardly with respect to the opposite thighs.

According to a second aspect of the invention, a portable leg exercise device is provided comprising a support, a central resistance element connected to the support, and first and second outer resistance elements connected to the support. The central resistance element is sized to fit between opposite thighs of an individual in a sitting position while the support rests above the opposite thighs, and is constructed and arranged to permit the individual to perform adductor thigh muscle movements. The outer resistance elements are situated on and spaced apart from opposite sides of the central resistance element by sufficient spacing to receive a first of the thighs between the central and first outer resistance elements and to receive a second of the thighs between the central and the second outer resistance elements. The outer resistance elements are constructed and arranged to permit the individual to perform abductor thigh muscle movements.

Other aspects of the invention reside in methods for exercising using the portable leg exercise device of the invention.

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings.

Figure 1:
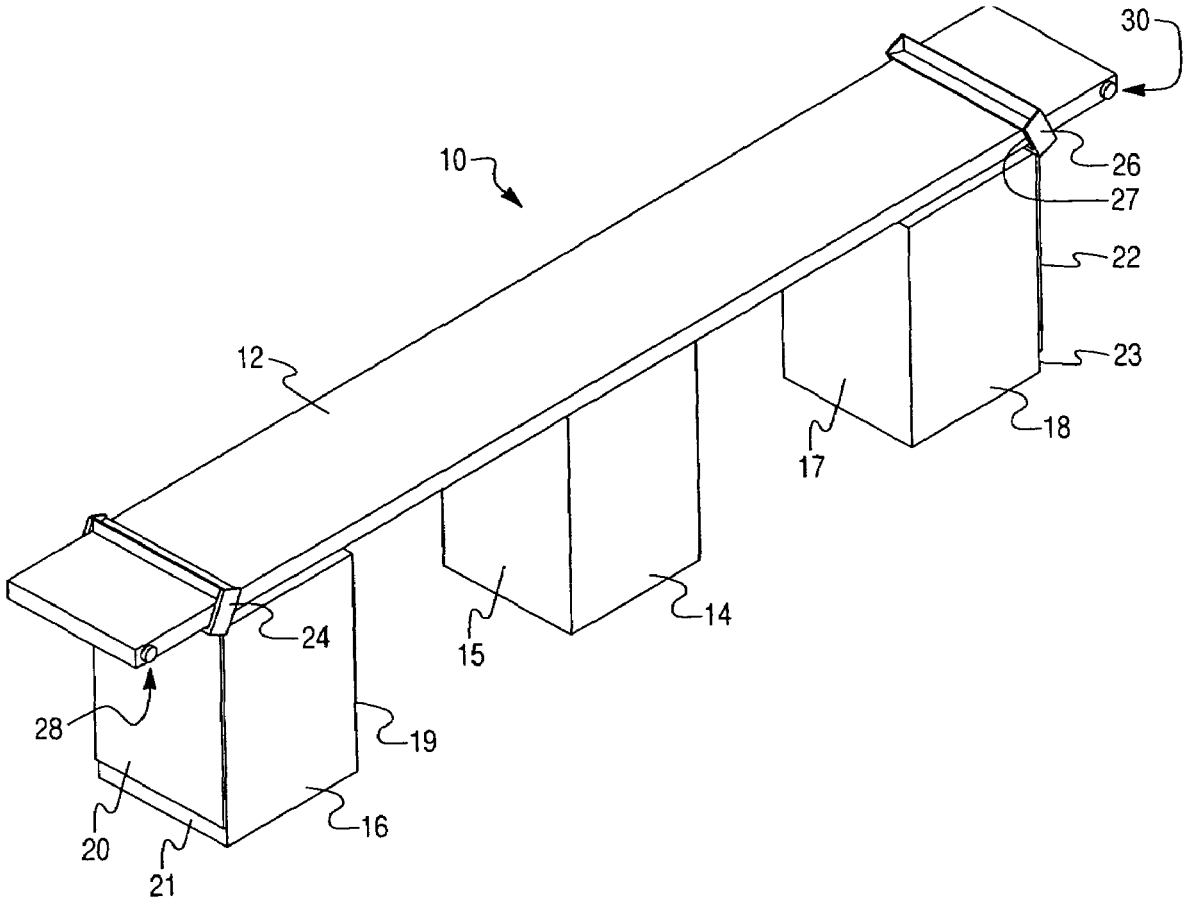
FIG. 1 is a top perspective view of a portable leg exercise device according to an embodiment of the present invention.

DETAILED DESCRIPTION OF CERTAIN PREFERRED EMBODIMENTS AND METHODS OF THE INVENTION

Reference will now be made in detail to the presently preferred embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

Figure 2:
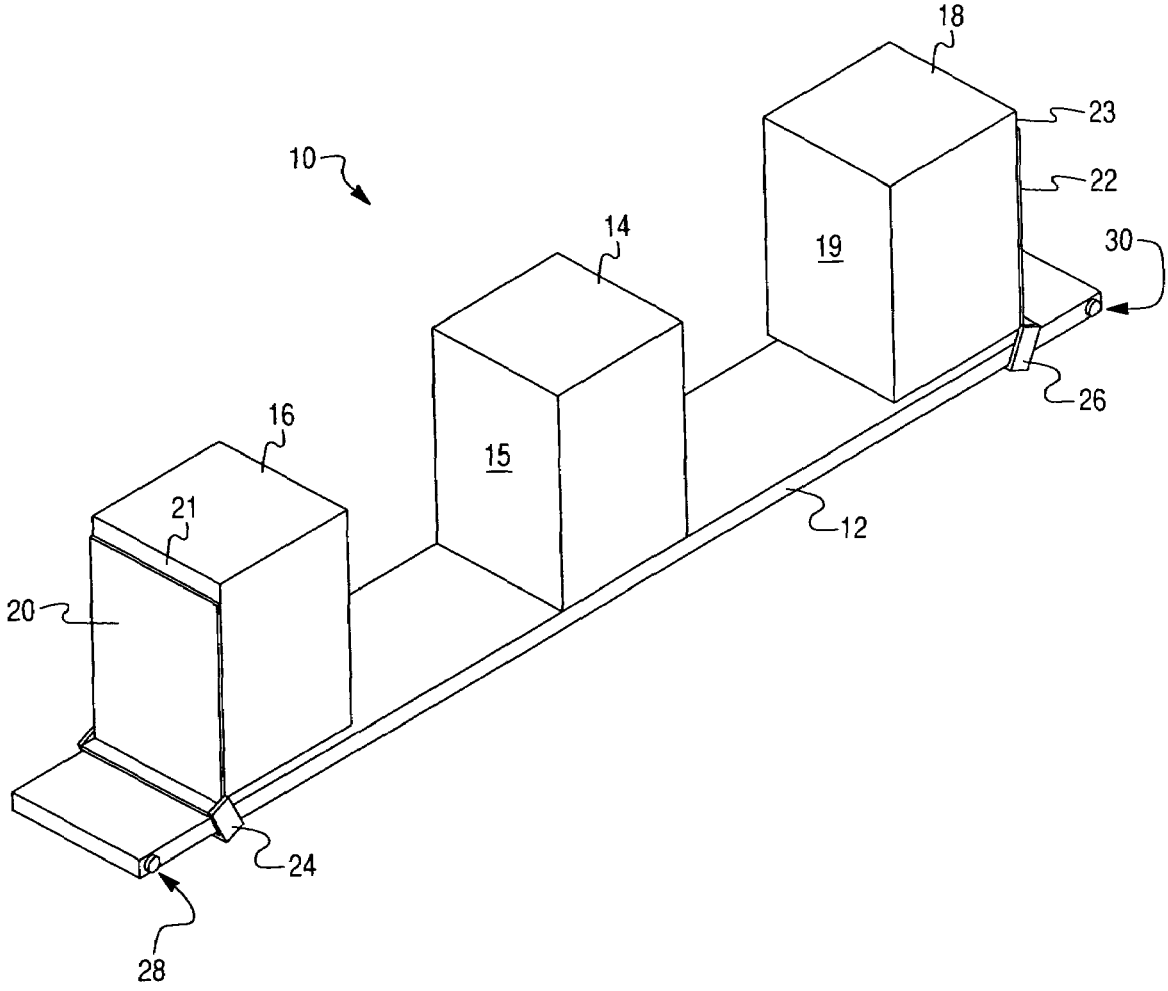
FIG. 2 is a bottom perspective view of the portable leg exercise device of FIG. 1.

Referring now more particularly to the views depicted in FIGS. 1 and 2, a portable leg exercise device according to an embodiment of the invention is generally designated by reference numeral 10.

Portable leg exercise device 10 comprises a support 12, which in the illustrated embodiment is configured as an elongated plate having generally rectangular opposing upper and lower surfaces and a substantially uniform thickness along its length. Although not shown in the figures, the corners and edges of support 12 may be beveled to remove any sharp perimeters that might injure or irritate the user. Support 12 may be made of any material having the sufficient strength to operate for its intended purpose. Examples of suitable materials include wood, plastics, composites, and metals. Preferably, support 12 is rigid and substantially inflexible. Support 12 can be made in a variety of lengths but is preferably long enough to accommodate a wide variety of different sized users that may all utilize the same device due to the adjustability of the resistance element 16 and 18, as will be described in detail below.

Centered on and connected directly or indirectly to the lower surface of support 12 is a central resistance element (or member) 14. Preferably yet optionally, the connection between support 12 and central resistance element 14 renders each stationary relative to the other, e.g., so that central resistance element 14 is not slidable along the length of support 12 during exercise. The mechanism or means for connecting support 12 and central resistance element 14 to one another is not particularly limited, and may comprise one or more mechanical fasteners (e.g., volts, screws), bonding agents (e.g., epoxies and glue), or a combination thereof. The top 13 of the support 12 can also be used as a hand or lower arm rest by the user during the exercise. In an alternative embodiment, the central resistance element 14 may be removable and replaceable with different resistance elements having different shapes or resistance to compressive forces. The user may either exert force with both legs against the surfaces 15 and 17 of the resistance element 14 or exert force with only one leg while leaving the other leg in a stationary position to accomplish the exercise.

Central resistance element 14 is sized to fit between opposite thighs of an individual in a seated position. Central resistance element 14 is constructed and arranged to permit the individual to perform adductor thigh muscle movements sufficient to generate compressive forces to deform the central resistance element between the opposite thighs. Central resistance element 14 also preferably has sufficient resiliency or shape memory to return substantially to its original shape and configuration after completing the adductor thigh muscle movements, e.g., after each repetition or after the individual's inner thighs fail to generate sufficient compressive force to deform the central resistance element 14. In the illustrated embodiment, central resistance element 14 comprises a deformable pad having opposite outward-facing expansive surfaces for distributing loads relatively evenly over respective inner portions of the opposite thighs of the individual. Outward-facing expansive surfaces are shown generally parallel to one another, although the surfaces may be angled or irregularly shaped if desired.

Portable leg exercise device 10 further comprises a first outer resistance element (or member) 16 and a second outer resistance element (or member) 18 situated on opposite sides of the central resistance element 14. First and second outer resistance elements 16, 18 are constructed and arranged to permit an individual to perform abductor thigh muscle movements. Preferably, first and second outer resistance elements 16 and 18 feature pads deformable by outward thigh motion of the abductor thigh muscle movement generating sufficient force to overcome the shape memory characteristics of the pads. The illustrated elements 16 and 18 have inward facing expansive surfaces 17 and 19, respectively for distributing loads over respective outer portions of the opposite thighs of the individual. The inward facing expansive surfaces 17 and 19 are shown generally parallel to one another, although the surfaces may be angled relative to one another if desired.

The deformable pads preferred for resistance elements 14, 16 and 18 may be made of the same or different materials, and may comprise, for example, foam or other resiliently deformable materials. Resistance elements 14, 16 and 18 also may possess configurations other than the rectangular shape shown in FIGS. 1 and 2, and may include curvatures and contours. Additionally, it should be understood that resistance elements 14, 16, and 18 may take other forms. For example, elements 14, 16 and 18 may comprise biasing and urging members, such as springs and helical springs, piston-cylinders, etc., which may be used alone or supplement the deformable resistance elements 14, 16 and 18. The elements 14, 16 and 18 may also be selectively removable from the support 12 in order to permit substitution of other elements having different compressive or other characteristics to provide progressive training over time or accommodation of particular physical problems or irregularities or users.

The outward-facing surfaces 21 and 23 of first and second outer resistance elements 16, 18 are connected to first and second adjustor plates 20, 22, respectively, using fastener and/or bonding agents, as discussed above with regard to the connection between support 12 and central resistance element 14. Adjustor plate 20 is integrally connected to a slidable mount bracket (or collar) 24 fitted around support 12. Similarly, adjustor plate 22 is integrally connected to a slidable mount bracket (or collar) 26 fitted around and preferably enclosing support 12. Portable leg exercise device 10 further comprises stops 28 and 30 for restricting the sliding of brackets 24, 26 on support 12, as discussed in greater detail below. Adjustor plates 20, 22, mount brackets 24, 26, and stops 28, 30 may be made of the same or different materials, including, for example, metals, plastics, composites, and any other material having sufficient mechanical properties to perform and endure their intended operations, although the materials are preferably relatively rigid.

Figure 3:
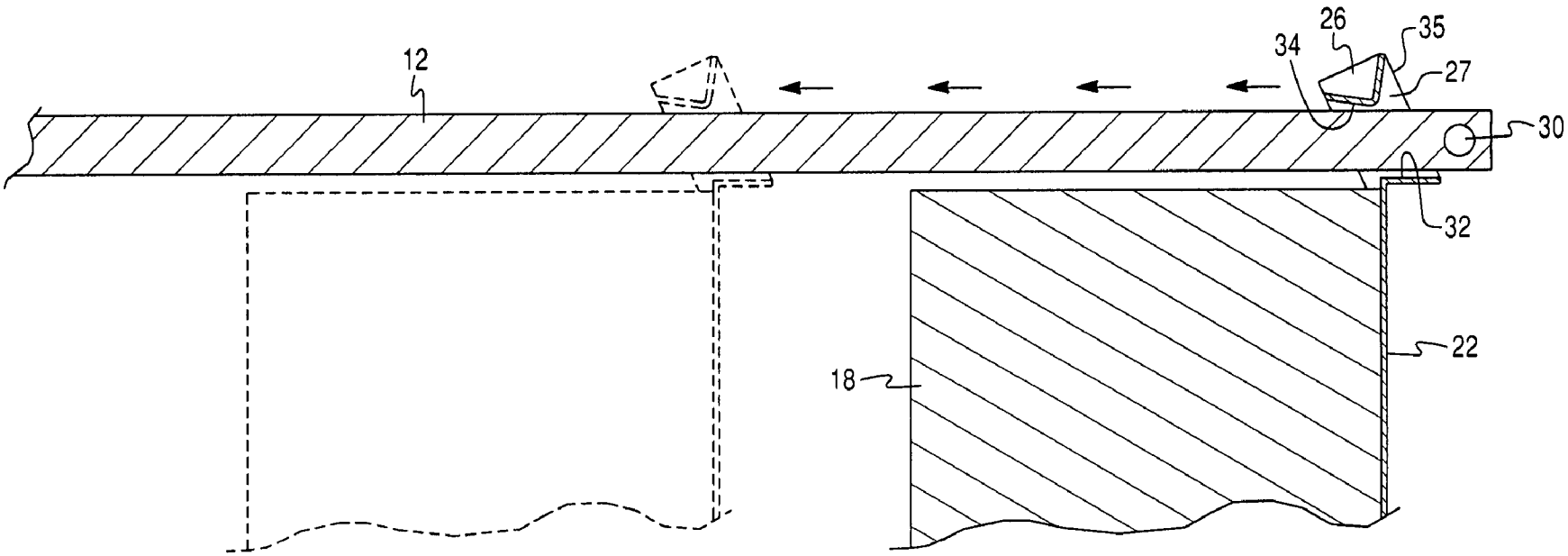
FIG. 3 is a side sectional view of a mount bracket of the portable leg exercise device of FIG. 1 shown in unlocked position, depicting sliding motion thereof.
Figure 4:
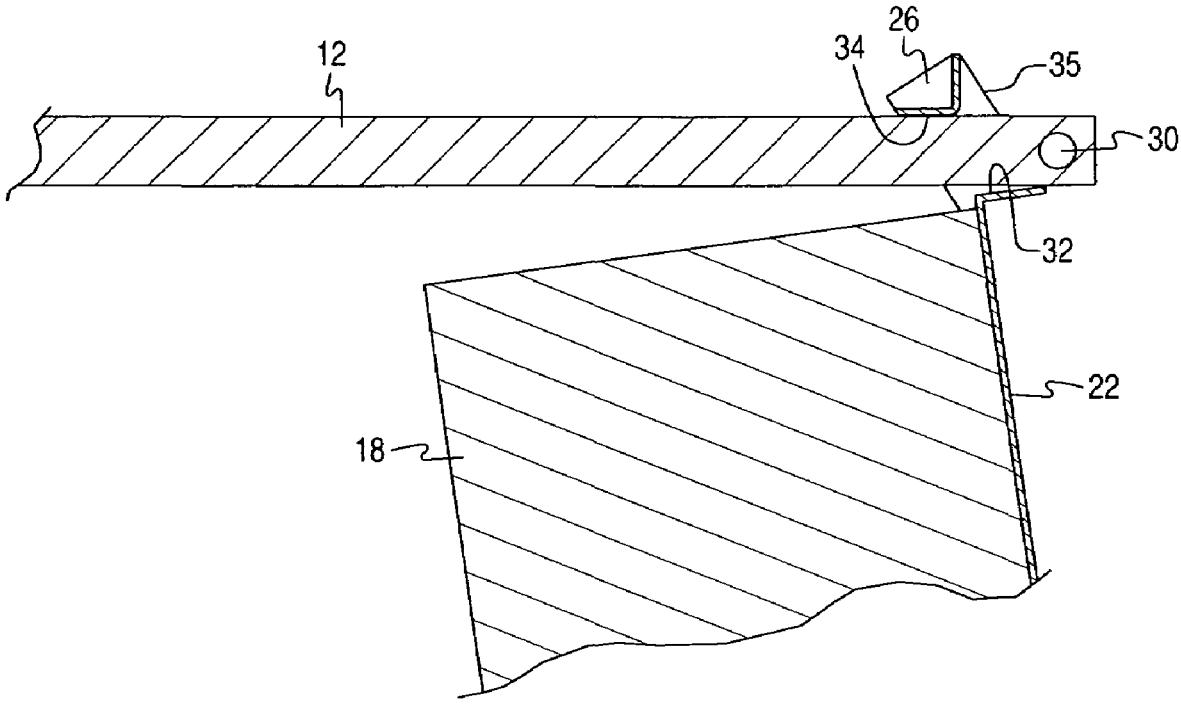
FIG. 4 is a side section view of the mount bracket of FIG. 3 shown in locked position.

Referring to FIGS. 1-4, the mount bracket 26 will now be described in greater detail. Because mount bracket 24 is the substantially identical mirror image of bracket 26, the below description will be limited mostly to mount bracket 26 in the interest of brevity, although it should be understood that illustrated mount bracket 24 shares similar characteristics and functions to mount bracket 26. Mount bracket 26 includes a slot 27 bounded by a slot-defining bottom surface 32, top surface 34, and side surfaces 35 of mount bracket 26. The slot-defining side surfaces 35 are set at an oblique angle relative to support 12 to offset slot-defining top surface 34 further inwardly towards center resistance element 14 compared to slot-defining bottom surface 32. Slot-defining top and bottom surfaces 32, 34 and side surfaces are spaced from one another sufficiently to define the slot 35 of mount bracket 26 slightly wider and higher than the cross-sectional profile of support 12. The over-sizing of mount bracket 26 slot permits mount bracket 26 and its interconnected adjustor plate 22 and outer resistance element 18 to tilt between an unlocked position (FIG. 3) and a locked position (FIG. 4).

In the unlocked position shown in FIG. 3, at least one of slot-defining bottom and top surfaces 32, 34 is spaced from support 12. (When support 12 is suspended from the thighs, the top surface will rest on support 12 and the bottom surface will be spaced from support 12.) In the illustrated embodiment, the unlocked position may be attained by arranging outer resistance element 18 in substantially perpendicular relationship with the bottom surface of support 12. Once arranged in the unlocked position, mount bracket 26 is slidable along the length of support 12 towards and away from central resistance element 14, with the range of inward sliding motion limited by central resistance element 14 and outward sliding motion limited by stop 30. For example, in the unlocked position mount brackets 24, 26 are slidable to establish adequate spacing between opposite surfaces of central resistance element 14 and outer resistance elements 16, 18 to receive the opposite thighs of a sitting individual while support 12 rests atop the opposite thighs.

Stop 30 limits the outward movement of mount bracket 26 to prevent mount bracket 26 from sliding out of engagement with support 12. (Similarly, stop 28 limits outward sliding movement of mount bracket 24.) In FIGS. 1 and 2, stops 28, 30 are illustrated as projections extending from the opposite edges of each end of support 12. These projections may comprise the heads to screws or bolts, for example or other similar elements extending a sufficient distance away from the support to prevent the sliding of the brackets 24 and 26 off of the ends of the support 12.

As also shown in FIGS. 3 and 4, controlled switching of the device from an unlocked to a locked position is attained by rotating or tilting the resistance element 18 causing the bottom thereof to flare outward. The tilting motion imparted to element 18 essentially rotates bracket 26, abutting bottom and top surfaces 32, 34 against opposite faces of support 12 at offset longitudinal locations. Preferably, top surface 34 is substantially flush against the top surface of support 12 in the locked position, as shown in FIG. 4. The resulting offset, dual abutment of surfaces 32, 34 against opposite surfaces of support 12 arrests bracket 26 from further rotational motion, causing slot surfaces 32, 34 to wedge on support 12. This wedge effect grips mount bracket 26 to prevent it from sliding lengthwise along support 12. Advantageously, in use the outward thigh movement associated with abductor exercises tilts outer resistance element 18 outward and causes mount bracket 26 to move into its locked position. As a consequence, mount bracket 26 and its associated adjustor plate 22 are automatically locked in placed to prevent sliding movement of outer resistance element 18 (and associated adjustor plate 22 and mount bracket 26) during abductor thigh muscle exercises. As a consequence, abductor thigh muscle movement causes outer resistance element 18 to compress between the outer thigh and locked adjustor plate 22.

It should be understood that mount brackets 24, 26 and stops 28, 30 may be replaced or supplemented with alternative or additional mechanisms to control positioning and limit sliding movement of outer resistance elements 16, 18. For example, mount brackets 24, 26 may include lock pins each selectively securable into one of a plurality of longitudinally spaced, lock pin receiving apertures in support 12. As another possible modification, device 10 is constructed to permit the user to selectively remove stops 28, 30 from device 10 to permit mount brackets 24, 26 to be slid over the ends of and disengaged from support 12 for storage or replacement with brackets having resistance elements with different shapes or compressive properties.

A preferred method of operation of portable leg exercise device 10 will now be explained in detail. It should be understood that possible uses of device 10 is not necessarily limited to the method described below.

Mount brackets 24, 26 are arranged in their respective unlocked positions, and first and second outer resistance elements 16, 18 are slid outward away from central resistance element 14. Device 10 is lowered from above the sitting user's thighs downward until the bottom surface of support 12 rests directly above and in contact with the top portion of seated user's thighs, so that resistance elements 14, 16, 18 are suspended downward from support 12, as shown in FIG. 1. The user places his inner thighs in close proximity or contact with central resistance element 14, and outer resistance element 16, 18 are slid inward (FIG. 3) until placed in close proximity or contact with the outer thighs.

Adductor thigh muscle movement is performed by drawing the knees together, with central resistance element 14 positioned between the thighs. In the event that a deformable pad is selected as central resistance element 14, the pad provides resistance against the adductor movement. On the other hand, abductor thigh muscle movement is performed by expanding the knees outward away from one another, so that the outer portions of the thighs press against outer resistance elements 16, 18. Outward thigh movement tilts outer resistance elements 16, 18 outward as shown in FIG. 4, thereby automatically wedging mounts 24, 26 in their locked position to prevent unintended outward sliding movement of adjustor plates 20, 22 during performance of abductor exercises. The outward thigh movement associated with abductor muscle movement compresses outer resistance elements 16, 18 between the outer thighs and locked adjustor plates 20, 22, which in the locked position are rendered stationary against sliding motion. Resistance is provided in the illustrated embodiment by deformation of pads constituting outer resistance elements 16, 18.

Various exercise routines may be performed. For example, the exerciser can perform one or more sets of alternating repetitions of adductor and abductor exercise movements. Alternatively, the exerciser can alternate sets of adductor exercises with abductor exercises, or complete the exercises consecutively. The device 10 may also be used to isolate and exercise a single leg at a time by moving one leg while keeping the opposite leg stationary. Portable leg exercise device 10 optionally may be incorporated into an overall exercise routine that works other lower extremity muscles and optionally upper body muscles.

When finished an exercise routine, the exerciser simply arranges outer resistance elements 16, 18 in a non-tilted position and slides mount brackets 24, 26 outward. Device 10 is then lifted from the thighs.

Portable leg exercise device 10 is particularly useful for persons having varying degrees of physical disabilities, such as those persons using or reliant upon wheelchairs. One advantage of exercise device 10 is that such wheelchair-bound persons need not leave their wheelchairs to operate device 10. Depending upon the ability of the user, most if not all of the exercises can be performed without requiring assistance from another person. Use of exercise device 10 is not limited to paraplegics and other wheelchair-bound persons, however. For example, exercise device 10 is useful for rehabilitation purposes, such as those persons suffering lower extremity injuries but not restricted to a wheelchair. Exercise device 10 is also useful for other individuals, such as the elderly or those requiring or desiring lower body muscle toning. It should be understood that healthy persons having minimal or no physical disabilities may also derive actual benefit from use of device 10.

Additionally, the dimensional compactness and light weight of leg exercise device 10 makes it suitable for home use, although the device may be employed in multi-user environments, such as health clubs, gyms, physical therapy facilities, hospitals, rehabilitation centers, extended healthcare facilities, and the like.

The foregoing detailed description of the certain preferred embodiments of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Modifications and equivalents will be apparent to practitioners skilled in this art and are encompassed within the spirit and scope of the appended claims.

What is claimed is:

1. A portable leg exercise device, comprising:

a support;

a resiliently compressible central resistance element connected to the support and sized to fit between opposite thighs of an individual in a seated position, the central resistance element having sufficient compressibility to permit the individual to perform adductor thigh muscle movements to resiliently deform the central resistance element between the opposite thighs;

resiliently compressible first and second outer resistance elements situated on opposite sides of the central resistance element; and first and second adjustor plates operatively connected to the first and second outer resistance elements, respectively, and movably connected to the support to permit relative movement of the first adjustor plate and the first outer resistance element towards and away from the central resistance element to establish sufficient spacing to receive a first of the thighs between the central and first outer resistance elements, and to permit relative movement of the second adjustor plate and the second outer resistance element towards and away from the central resistance element to receive a second of the thighs between the central and the second outer resistance elements, the outer resistance elements having sufficient compressibility to permit the individual to perform abductor thigh muscle movements to resiliently deform the outer resistance elements outwardly with respect to the opposite thighs.

2. The portable leg exercise device of claim 1, wherein the central resistance element and the outer resistance elements each comprise a respective formable pad.

3. The portable leg exercise device of claim 1, wherein:

the central resistance element has opposite outward-facing expansive surfaces for accommodating respective inner portions of the opposite thighs of the individual; and the first and second outer resistance elements have respective inward facing expansive surfaces for accommodating respective outer portions of the opposite thighs of the individual.

4. The portable leg exercise device of claim 1, wherein the central resistance element is fixedly connected to the support to prevent sliding movement of the central resistance element along the length of the support.

5. The portable leg exercise device of claim 4, further comprising a first mount bracket slidably connecting the first adjustor plate to the support and a second mount bracket slidably connecting the second adjustor plate to the support for controlling selective sliding movement of the outer resistance elements along the length of the support.

6. The portable leg exercise device of claim 5, further comprising:

first and second locking mechanism operatively associated with the first and second outer resistance elements, respectively, for preventing outward sliding movement of the outer resistance elements during performance of the abductor thigh muscle movements.

7. The portable leg exercise device of claim 6, wherein the first and second mounting brackets are constructed and arranged to automatically lock in place during the abductor thigh muscle movements.

8. The portable leg exercise device of claim 1, wherein abductor thigh muscle movements cause the first outer resistance element to compress between the first thigh and the first adjustor plate and the second outer resistance element to compress between the second thigh and the second adjustor plate.

9. The portable leg exercise device of claim 1, wherein the support is constructed and arranged to rest on top of and in contact with the opposite thighs.

10. A portable leg exercise device, comprising:

a support;

a central resistance element connected to the support and sized to fit between opposite thighs of an individual in a seated position while the support rests above the opposite thighs, the central resistance element constructed and arranged to permit the individual to perform adductor thigh muscle movements;

first and second outer resistance elements situated on opposite sides of the central resistance element, the first and second resistance elements being movably connected to the support to permit creation of by sufficient spacing to receive a first of the thighs between the central and first outer resistance elements and to receive a second of the thighs between the central and the second outer resistance elements, the outer resistance elements constructed and arranged to permit the individual to perform abductor thigh muscle movements; and first and second locking mechanisms comprising mounting brackets constructed and arranged to automatically lock the first and second outer resistance elements in place during the abductor thigh muscle movement.

11. The portable leg exercise device of claim 10, wherein the support is constructed and arranged to rest on top of and in contact with the opposite thighs.

12. The portable leg exercise device of claim 10, wherein the central resistance element comprises a resiliently compressible central resistance element having sufficient compressibility to permit the individual to perform adductor thigh muscle movements to resiliently compress the central resistance element between the opposite thighs.

13. The portable leg exercise device of claim 10, wherein the first and second outer resistance elements comprise resiliently compressible first and second outer resistance elements, respectively, the outer resistance elements having sufficient compressibility to permit the individual to perform abductor thigh muscle movements to resiliently deform the outer resistance elements outwardly with respect to the opposite thighs.

14. The portable leg exercise device of claim 10, wherein:

the central resistance element is fixedly connected to the support to prevent sliding movement of the central resistance element along the length of the support; and the first and second outer resistance elements are each slidably connected to the support for permitting selective sliding movement of the outer resistance elements along the length of the support.

15. The portable leg exercise device of claim 10, further comprising:

first and second adjustor plates situated on outward facing surfaces of the first and second outer resistance elements, respectively, the first and second adjustor plates operatively connected to the first and second mounting brackets, respectively, wherein the abductor thigh muscle movements cause the first outer resistance element to compress between the first thigh and the first adjustor plate and the second outer resistance element to compress between the second thigh and the second adjustor plate.

16. A method of exercising thigh muscles, comprising:

providing a device according to claim 1 comprising a support;

a resiliently compressible central resistance element connected to the support and sized to fit between opposite thighs of an individual in a seated position, the central resistance element having sufficient compressibility to permit the individual to perform adductor thigh muscle movements to resiliently deform the central resistance element between the opposite thighs; and resiliently compressible first and second outer resistance elements connected to the support, and situated on and spaced apart from opposite sides of the central resistance element by sufficient spacing to receive a first of the thighs between the central and first outer resistance elements and to receive a second of the thighs between the central and the second outer resistance elements, the outer resistance elements having sufficient compressibility to permit the individual to perform abductor thigh muscle movements to resiliently deform the outer resistance elements outwardly with respect to the opposite thighs;

situating the resiliently compressible central resistance element of the device between opposite first and second thighs of an individual; and performing adductor thigh muscle movements to resiliently deform the central resistance element between the opposite thighs.

17. The method of claim 16, further comprising:

situating the first thigh between the central resistance element and the first outer resistance element;

situating the second thigh between the central resistance element and the second outer resistance element; and sliding the first and second outer resistance elements inward towards the central resistance element until each of the outer resistance elements comes into contact with a respective outer portion of the opposite thighs; and performing abductor thigh muscle movements to resiliently deform the outer resistance elements outwardly with respect to the opposite thighs.

18. A method of exercising thigh muscles, comprising:

providing a device according to claim 10 comprising a support;

a central resistance element connected to the support and sized to fit between opposite thighs of an individual in a seated position while the support rests above the opposite thighs, the central resistance element constructed and arranged to permit the individual to perform adductor thigh muscle movements; and first and second outer resistance elements connected to the support, and situated on and spaced apart from opposite sides of the central resistance element by sufficient spacing to receive a first of the thighs between the central and first outer resistance elements and to receive a second of the thighs between the central and the second outer resistance elements while the support rests above the opposite thighs of the seated individual, the outer resistance elements constructed and arranged to permit the individual to perform abductor thigh muscle movements;

situating the resiliently compressible central resistance element of the device between opposite first and second thighs of an individual; and performing adductor thigh muscle movements to resiliently deform the central resistance element between the opposite thighs.

19. The method of claim 18, further comprising:

situating the first thigh between the central resistance element and the first outer resistance element;

situating the second thigh between the central resistance element and the second outer resistance element; and sliding the first and second outer resistance elements inward towards the central resistance element until each of the outer resistance elements comes into contact with a respective outer portion of the opposite thighs; and performing abductor thigh muscle movements to resiliently deform the outer resistance elements outwardly with respect to the opposite thighs.

20. The method of claim 16, wherein:

the device further comprises first and second adjustor plates connected to the first and second outer resistance elements, respectively, and movably connected to the support to permit relative movement of the first adjustor plate and the first outer resistance element towards and away from the central resistance element to establish sufficient spacing to receive the first thigh between the central and first outer resistance elements, and to permit relative movement of the second adjustor plate and the second outer resistance element towards and away from the central resistance element to receive the second thigh between the central and the second outer resistance elements, the method further comprises performing abductor thigh muscle movements to cause the first outer resistance element to compress between the first thigh and the first adjustor plate and the second outer resistance element to compress between the second thigh and the second adjustor plate.

21. The method of claim 16, wherein:

the device further comprises first and second locking mechanisms comprising mounting brackets constructed and arranged to automatically lock the first and second outer resistance elements in place during the abductor thigh muscle movement.

22. The method of claim 18, wherein:

the device further comprises first and second adjustor plates movably connected to the support to permit relative movement of the first adjustor plate and the first outer resistance element towards and away from the central resistance element to establish sufficient spacing to receive the first thigh between the central and first outer resistance elements, and to permit relative movement of the second adjustor plate and the second outer resistance element towards and away from the central resistance element to receive the second thigh between the central and the second outer resistance elements, the method further comprises performing abductor thigh muscle movements to cause the first outer resistance element to compress between the first thigh and the first adjustor plate and the second outer resistance element to compress between the second thigh and the second adjustor plate.

23. The method of claim 18, wherein:

the device further comprises first and second locking mechanisms comprising mounting brackets constructed and arranged to automatically lock the first and second outer resistance elements in place during the abductor thigh muscle movement.

* * * * *